US005825125A

United States Patent [19]

Ligthart et al.

[11] Patent Number: 5,825,125

[45] **Date of Patent: *Oct. 20, 1998**

[54] NEON DISCHARGE LAMP

[75] Inventors: Franciscus A. S. Ligthart; Rolf E. De Man; Christianus J. Roozekrans; Dick Van Der Voort, all of Eindhoven, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 592,259

[22] Filed: Jan. 26, 1996

[30] Foreign Application Priority Data

Jan. 30, 1995 [EP] European Pat. Off. ..... 95200225

[51] Int. Cl.[6] ..... H01J 61/16

[52] U.S. Cl. ..... 313/485; 313/487; 313/489; 313/572; 313/573; 315/326

[58] Field of Search ..... 313/484, 485, 313/486, 487, 489, 572, 573, 576, 643; 315/326

[56] References Cited

U.S. PATENT DOCUMENTS

| | | | |
|---|---|---|---|
| 1,886,186 | 8/1932 | Hilgenberg | 313/631 |
| 4,000,436 | 12/1976 | Toryu et al. | 313/487 |
| 4,039,889 | 8/1977 | Vicai | 313/487 |
| 4,716,337 | 12/1987 | Huiskes et al. | 313/487 |
| 5,159,237 | 10/1992 | Ishikawa et al. | 313/486 |
| 5,274,305 | 12/1993 | Bouchard | 315/108 |
| 5,523,655 | 6/1996 | Jennato et al. | 315/246 |

FOREIGN PATENT DOCUMENTS

| | | | |
|---|---|---|---|
| 0124175B1 | 11/1984 | European Pat. Off. | H01J 61/44 |
| 0562679A1 | 9/1993 | European Pat. Off. | H01J 61/09 |

*Primary Examiner*—Sandra L. O'Shea
*Assistant Examiner*—Michael Day
*Attorney, Agent, or Firm*—F. Brice Faller

[57] ABSTRACT

A lighting unit includes a discharge vessel having a wall provided with a first luminescent layer, a gas fill consisting essentially of neon at a pressure less than 30 mbar, and a means for providing a constant DC current for exciting the fill in the discharge vessel to emit UV light for exciting the luminescent layer. DC operation offers substantially higher luminous flux over AC operation. The lighting unit may further include a housing having a reflective surface, a second luminescent layer, and a filter incorporated within the discharge vessel.

18 Claims, 6 Drawing Sheets

NEON DISCHARGE LAMP

BACKGROUND OF THE INVENTION

The invention relates to a lighting unit comprising a discharge lamp provided with a gas filling comprising mainly neon, a housing having a reflecting surface, and means for positioning the discharge lamp in the housing.

The invention also relates to a discharge lamp suitable for use in such a lighting unit.

A discharge lamp provided with a gas filling comprising mainly neon is here understood to be a discharge lamp having a gas filling composition comprising neon such that red light is generated in the plasma during stationary lamp operation whose colour point in the C.I.E. chromaticity diagram lies within the region bounded by the lines y=0.300, y=0.350, y=−x+1, and y=−x+0.99.

A lighting unit as indicated above is known from European Patent EP 0562679. The lighting unit described in this European Patent is very suitable for acting as a stop light on or in a vehicle. The gas filling of the known discharge lamp comprises exclusively neon, and the life of such a lighting unit is long compared with traditional stop lights in which incandescent lamps are used. It is also possible to give the lighting unit a comparatively flat shape through a suitable choice of the dimensions of the discharge lamp. This flat shape increases the application possibilities of the lighting unit considerably because such a shape can be used in combination with, for example, a very wide variety of shapes of the portion of a vehicle on or in which the lighting unit is accommodated. Further advantages of the known lighting unit over traditional stoplights are the comparatively high luminous efficacy (1 m/W) and the fact that the discharge lamp emits light comparatively soon after the brake pedal has been operated, even at comparatively low temperatures. A disadvantage of the known lighting unit is the fact that the discharge lamp generates red light, which renders the lighting unit less suitable or unsuitable for a large number of applications.

SUMMARY OF THE INVENTION

It is an object of the invention to provide a lighting unit which has the advantageous properties described above but whose application possibilities are considerably increased.

According to the invention, a lighting unit as mentioned in the opening paragraph is for this purpose characterized in that a wall of the discharge lamp is provided with a luminescent screen comprising a first luminescent layer.

Operation of the discharge lamp generates besides the visible red light emitted by the lamp also short-wave ultraviolet light. This short-wave ultraviolet light is converted into visible light by the first luminescent layer. The total quantity of visible light generated by the discharge lamp is now composed of the visible light generated in the lamp plasma and the visible light generated from the short-wave ultraviolet radiation by the first luminescent layer. The colour of the total quantity of visible light generated by the lamp may be adjusted through a suitable choice of the composition of the first luminescent layer. It is possible to generate light of widely differing colours with a comparatively high luminous efficacy with the use of a comparatively simple first luminescent layer which generates no or only a small quantity of red light. The red light generated by the discharge lamp in this case is exclusively or substantially exclusively that originating from the plasma. Since part of the short-wave ultraviolet light that is generated in the plasma is converted into visible light, the luminous efficacy of the lighting unit according to the invention is considerably higher than that of the known lighting unit.

If the lighting unit is designed, for example, for use as a signal light source, such as a direction indicator on a vehicle, for example a motorcar, it is desirable for the lighting unit to radiate amber light when energized. Such a lighting unit is also very suitable for serving, for example, as a traffic light, as a backlight of an LCD screen, or for use in reprographic applications and image scanners. This amber light can be realised in that the first luminescent layer comprises a green-luminescing substance. Zinc silicate activated by bivalent manganese, yttrium-aluminium garnet activated by trivalent cerium, and yttrium silicate activated by trivalent terbium were found to be suitable for this application. More in particular, it was found to be possible with the use of yttrium-aluminium garnet activated by trivalent cerium to realise a discharge lamp with a comparatively high luminous efficacy whose colour point complies with the E.C.E. requirement for direction indicator lights to be used in/on a motorcar without the use of a filter. According to this requirement, the colour point of the radiated light must lie within a region in the I.E.C chromaticity diagram bounded by the lines y=0.429, y=0.398, y=−x+1, and y=−x+0.993.

More in particular satisfactory results were obtained in case the green-luminescing substance yttrium-aluminium garnet activated by trivalent cerium is of general formula $Y_{3-x}Al_5O_{12}:xCe^{3+}$, wherein $0.01 \leqq x \leqq 0.20$ preferably $0.02 \leqq x \leqq 0.10$.

It is noted that part of the aluminium in the yttrium-aluminium garnet activated by trivalent cerium may be replaced by gallium and/or scandium as described in European Patent EP 124175. If for instance half of the aluminium is replaced by gallium a luminescing substance of general formula $Y_{3-x}Al_{2.5}Ga_{2.5}O_{12}:xCe^{3+}$ is obtained. The colour point of this luminescing substance has a lower x-value than the colour point of $Y_{3-x}Al_5O_{12}:xCe^{3+}$. It was found that in case the first luminescent layer of the discharge lamp consists substantially of $Y_{3-x}Al_{2.5}Ga_{2.5}O_{12}:xCe^{3+}$ the visible light radiated by the discharge lamp was almost white.

In case yttrium silicate activated by trivalent terbium was used in the first luminescent layer it was necessary to incorporate a filter in order to meet the E.C.E. requirements for indicator lights mentioned hereabove. The filter is used to filter blue light radiated by the first luminescent layer. Satisfactory results were obtained using short wavelength blocking filters having 50% transmission at a wavelength within the range 450–550 nm.

Instead of using a filter in a lamp containing yttrium silicate activated by trivalent terbium in the first luminescent layer, it is also possible to meet the E.C.E requirements for indicator lights in case the luminescent screen comprises a second luminescent layer present between the first luminescent layer and the wall of the discharge vessel, said second luminescent layer comprising the green-luminescing substance yttrium-aluminium garnet activated by trivalent cerium. In this luminescent screen the green-luminescing substance yttrium-aluminium garnet activated by trivalent cerium in the second luminescent layer absorbs blue radiation generated by the yttrium silicate activated by trivalent terbium in the first luminescent layer. An important advantage of this composition of the luminescent screen is that the colour point of the light radiated by the discharge lamp can be adjusted over a relatively wide range within the area indicated hereabove within which the colour point meets the E.C.E requirements for indicator lights. Another important advantage of this composition of the luminescent screen is that it is possible to increase the amplitude of the lamp current and thereby the light output of the discharge lamp to a relatively high value while the colour point of the light radiated by the discharge lamp still meets the E.C.E requirements for indicator lights.

Of the yttrium-aluminium garnet activated by trivalent cerium present in this second luminescent layer part of the aluminium can be replaced by gallium and/or scandium.

In case the first luminescent layer comprises a blue-luminescing substance but no other luminescing substances the visible light radiated by the discharge lamp is a mix of the red light generated in the plasma and the blue light generated by the first luminescent layer. By a proper choice of the blue-luminescing substance it is possible to adjust the colour of this light over a wide range to suit a range of applications, while the luminescent layer as well as the gas filling of the discharge lamp are of a very simple composition.

In many applications it is desirable that the colour of the light radiated by the discharge lamp is white or nearly white. It was found to be possible to cause the colour of the light radiated by the discharge lamp to be white or nearly white in case the first luminescent layer comprises a green-luminescing substance and a blue-luminescing substance. Lighting units with a comparatively high luminous efficacy can be realised also in this case, the luminescent layer generating no or only a very small quantity of red light. Since the luminescent layer need not comprise a substance which luminesces in red, this layer may be of a comparatively simple composition. Very satisfactory results have been obtained in case the blue-luminescing substance comprises one or more of the luminescent materials belonging to the group formed by $MgWO_4$, $Y_{2-x}O_2S:xTb^{3+}$ and $Y_{2-x}SiO_5:xCe^{3+}$.

It has been found that, in case the pressure of the gas filling of the discharge lamp at ambient temperature is less than 30 mbar and the inner diameter of the lamp vessel is smaller than 5 mm, DC-operation of the discharge lamp wherein the lamp current is a DC-current of substantially constant amplitude surprisingly produces enough short-wave ultraviolet light to excite the luminescent substances in the luminescent screen. Important advantages of such a DC-operation are that it can be realized with relatively simple and inexpensive means and causes no or only a relatively small amount of electromagnetic interference.

BRIEF DESCRIPTION OF THE DRAWINGS

Embodiments of the lighting unit according to the invention are shown in a drawing, in which:

FIG. 6*a* shows colour points and luminous fluxes of discharge lamps having a neon gas filling and a luminescent layer both for AC- and DC-operation.

DESCRIPTION OF THE PREFERRED EMBODIMENTS

Figure 1:
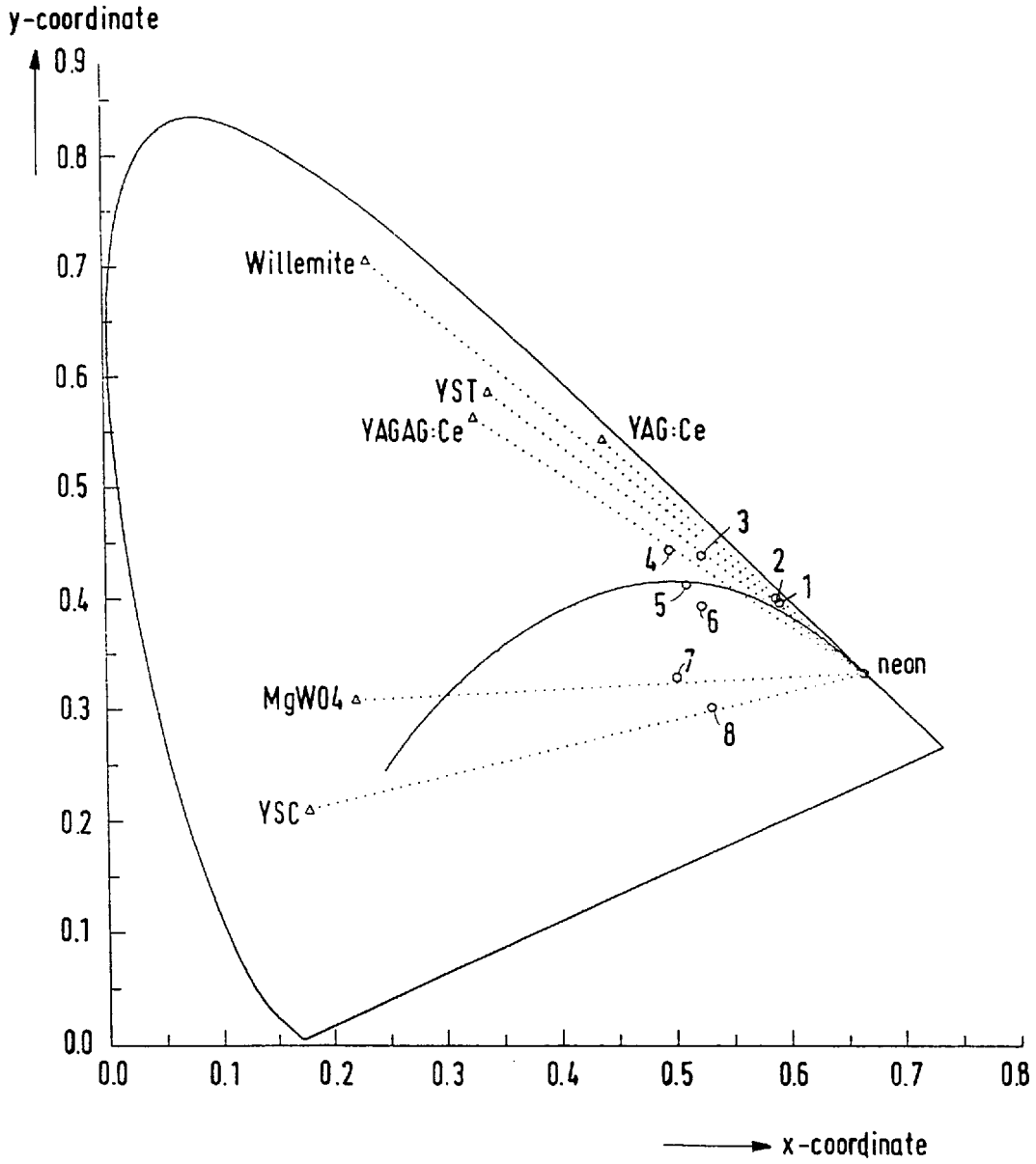
FIG. 1 shows the C.I.E. chromaticity diagram with the colour points of luminescent materials and the colour points of discharge lamps.

FIG. 1 shows the C.I.E. chromaticity diagram. The x coordinate of the colour point is plotted on the horizontal axis, the y coordinate of the colour point on the vertical axis. The reference word "neon" indicates the colour point (0.666, 0.332) of the red light radiated by a DC operated discharge lamp whose gas filling consists of neon. The colour point (0.440, 0.543) of the green light radiated by the luminescent material yttrium-aluminium garnet activated by trivalent cerium is indicated with YAG:Ce, this luminescent material being excited by ultraviolet radiation. The colour point (0.235, 0.705) of the green light radiated by the luminescent material zinc silicate activated by bivalent manganese is indicated with "willemite", this luminescent material being excited by ultraviolet radiation. Similarly YST indicates the colour point (0.341, 0.586) of the light radiated by yttrium silicate activated by trivalent terbium. YAGAG:Ce indicates the colour point (0.328, 0.563) of the light radiated by yttrium-aluminium-gallium garnet activated by trivalent cerium. The molar quantity of alumminium is approximately equal to the amount of gallium. $MgWO_4$ indicates the colour point (0.222, 0.309) of the light radiated by $MgWO_4$ and YSC indicates the colour point (0.180, 0.210) of the light radiated by yttrium silicate activated by trivalent cerium.

Colour points of the light radiated by discharge lamps provided with a gas filling that substantially consists of neon and comprising a luminescent layer containing one or more luminescent materials are indicated by reference numerals 1–8. These colour points will be further referred to as a colour point of a discharge lamp. The filling pressure of the neon was 15 mbar and the discharge lamps were operated with a DC current of 5 mA. The inner diameter of the discharge lamps was 2.5 mm and the length of the discharge vessel was 40 cm. The colour point (0.593, 0.396) of a discharge lamp provided with a neon gas filling and a luminescent layer comprising zinc silicate activated by bivalent manganese is indicated with 1. The colour point of such a discharge lamp is determined by the red light directly generated in the plasma of the discharge lamp and the green light obtained by means of the luminescent material, and lies on a straight line interconnecting the colour points "neon" and "willemite". The exact position of the colour point 1 on this line follows from the ratio in which green light and red light are mixed by the discharge lamp. This ratio is influenced, for example, by the filling pressure of the neon gas present in the discharge lamp and the current flowing through the discharge lamp during lamp operation. The colour point 1 corresponds to amber light so that a lighting unit containing such a discharge lamp is very suitable, for example, for use as a direction indicator on a vehicle such as a motorcar. In a similar manner, it is possible to manufacture discharge lamps with a gas filling consisting of neon whose colour points lie on a straight line between the colour points "neon" and YAG:Ce through the use of the luminescent material yttrium-aluminium garnet activated by trivalent cerium in the luminescent layer. Colour point 2 (0.590, 0.400) is the colour point of such a discharge lamp. Since colour point 2 has a somewhat higher y-value than colour point 1 it is easier to meet the E.C.E. requirements for direction indicator lights, when use is made of yttrium-aluminium garnet activated by trivalent cerium than when use is made of zinc silicate activated by bivalent manganese. Similarly colour points 3 (0.525, 0.438), 4 (0.497, 0.443), 7 (0.503, 0.328) and 8 (0.533, 0.301) are the colour points of discharge lamps comprising a luminescent layer that contains the luminescent material that lies on the line through the colour point "neon" and the colour point of the discharge lamp. Colour point 5 is the colour point of a discharge lamp with a luminescent layer comprising a mixture of yttrium-aluminium-gallium garnet activated by trivalent cerium and $MgWO_4$. In the garnet the molar quantity of aluminium is approximately equal to the molar quantity of gallium. The resulting colour point of the discharge lamp (x=0.512, y=0.412) is near white. Colour point 6 is the colour point of a discharge lamp with a luminescent layer comprising a mixture of yttrium silicate activated by trivalent terbium and $MgWO_4$. Also in this case the resulting colour point of the discharge lamp (x=0.525, y=0.393) is near white.

Figures 2A, 2B:
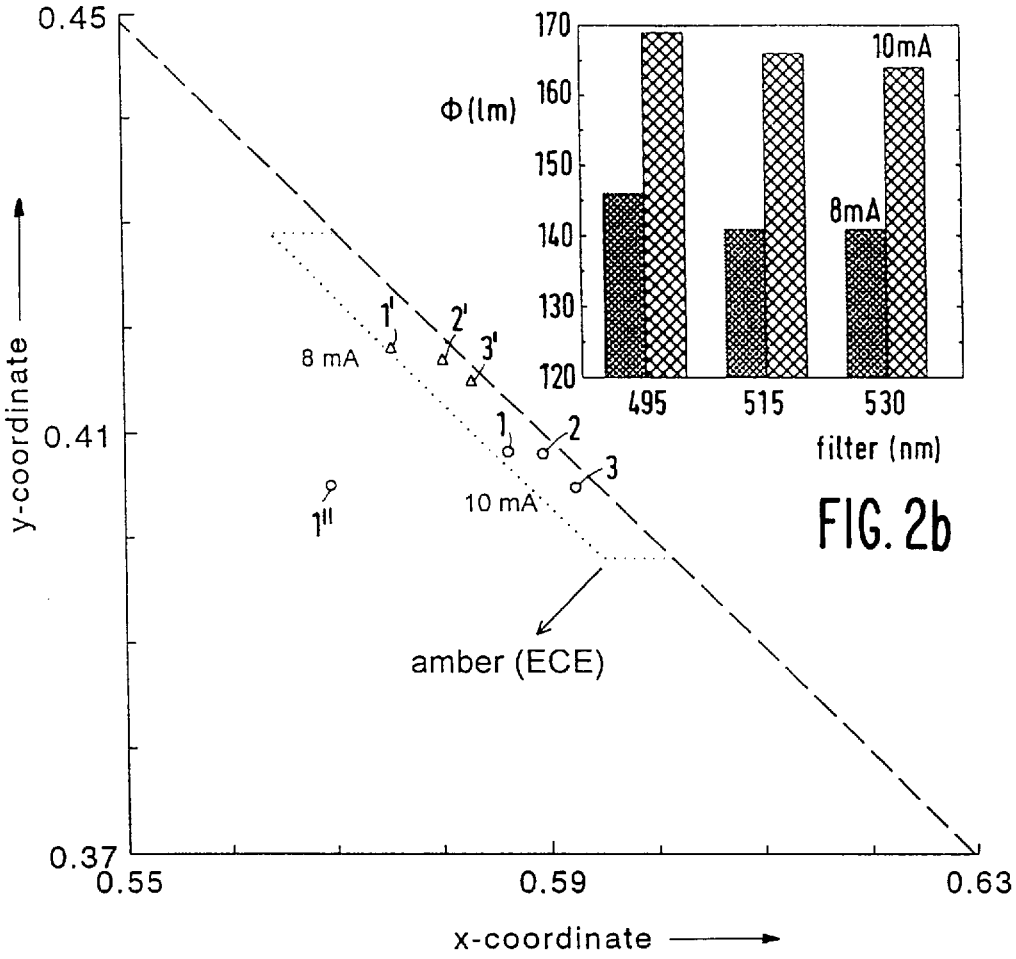
FIG. 2*a* shows colour points of discharge lamps wherein the first luminescent layer comprises the green- luminescing substance yttrium silicate activated by trivalent terbium.
FIG. 2*b* shows luminous fluxes of discharge lamps wherein the first luminescent layer comprises the green luminescing substance yttrium silicate activated by trivalent terbium.

In FIGS. 2*a* and 2*b* respectively, colour points and luminous fluxes of discharge lamps provided with a neon gas filling and with a luminescent layer containing yttrium silicate activated with trivalent terbium are shown. FIG. 2*a* also shows the region in the I.E.C chromaticity diagram bounded by the lines y=0.429, y=0.398, y=−x+1 and y=−x+0.993. The E.C.E. requires that the colour point of (discharge) lamps that are used as direction indicator lights in or on a motorcar must be within this region. The neon filing pressure was 15 mbar, the inner diameter of the discharge vessel was 2.5 mm and the length of the discharge vessel was 40 cm. Colour point 1" represents the colour point of such a discharge lamp not comprising a filter. It can be seen in FIG. 2*a* that the colour point 1" does not meet the E.C.E. requirements. Colour points 1–3 and 1'–3' were measured for discharge lamps having the same luminescent layer, but being additionally equipped with a short wavelength blocking filter. Colour point 1 and 1' were measured for a discharge lamp equipped with a short wavelength blocking filter having 50% transmission at 495 nm. Similarly colour points 2 and 2' were measured for a discharge lamp equipped with a short wavelength blocking filter having 50% transmission at 515 nm. Colour points 3 and 3' were measured for a discharge lamp equipped with a short wavelength blocking filter having 50% transmission at 530 nm. In case of the colour points 1', 2' and 3' the discharge lamps were operated with a DC current of approximately 8 mA. In case of colour points 1, 2 and 3 the discharge lamps were operated with a DC-current of approximately 10 mA. It can be seen that the colour points 1–3 and 1'–3' all meet the E.C.E. requirements for direction indicator lights for motorcars. The luminous fluxes (Φ) of the discharge lamps equipped with a filter are also shown in FIG. 2*b* for both operation with a DC current of 8 mA and operation with a DC current of 10 mA. It can be seen that the luminous flux of the discharge lamps equipped with a filter are relatively high when these discharge lamps are operated with a DC current of 10 mA.

Figure 3:
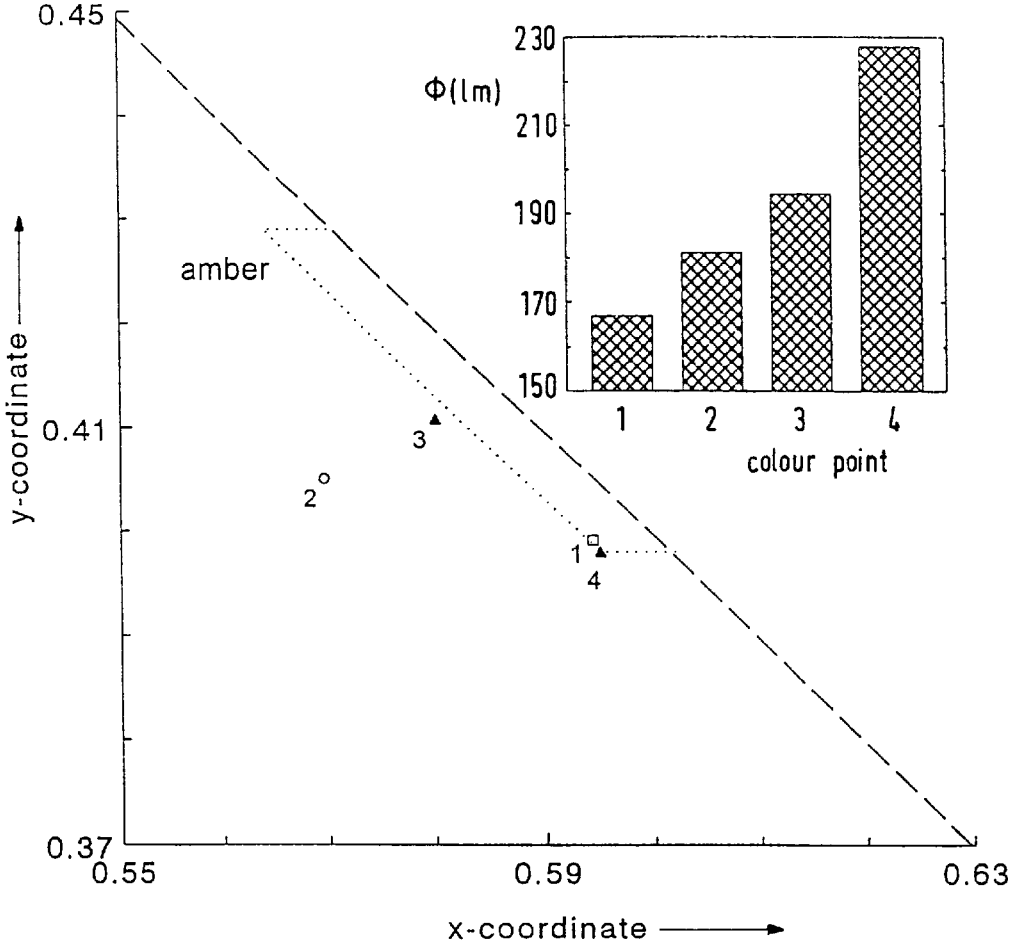
FIG. 3*b* shows luminous fluxes of discharge lamps comprising one or more luminescent layers.

In FIGS. 3*a* and 3*b* respectively, both colour points and luminous fluxes for discharge lamps having a neon gas filling and a luminescent layer are shown. The neon filling pressure was 15 mbar, the inner diameter of the discharge vessel was 2.5 mm and the length of the discharge vessel was 40 cm. Again the colour point region corresponding to the E.C.E. requirements for direction indicator lights is shown. Colour point 1 was measured for a discharge lamp having a luminescent layer consisting of yttrium aluminium garnet activated with trivalent cerium and operated with a DC current of 8 mA. Colour point 2 was measured for a discharge lamp with a luminescent layer consisting of yttrium silicate activated with trivalent terbium and operated with a DC current of 10 mA. Colour points 3 and 4 were measured for discharge lamps having a first luminescent layer LU consisting of yttrium silicate activated with trivalent terbium and a second luminescent layer LU present between the first luminescent layer and the wall of the discharge vessel, said second luminescent layer consisting of yttrium aluminium garnet activated with trivalent cerium see FIG. 7*d*. Colour point 3 was measured when the discharge lamp was operated with a DC current of 10 mA and colour point 4 was measured when the discharge lamp was operated with a DC current of 14 mA. It can be seen that colour point 1 and colour point 4 are within the region corresponding to the E.C.E. requirements. The luminous fluxes that were measured at the same time as the colour points are also shown in FIG. 3*b*. It can be seen that the discharge lamp with two luminescent layers can be operated in such a way that the colour point meets the E.C.E. requirements for indicator lights for motorcars while at the same time the luminous flux of the discharge lamp is relatively high.

Figure 4:
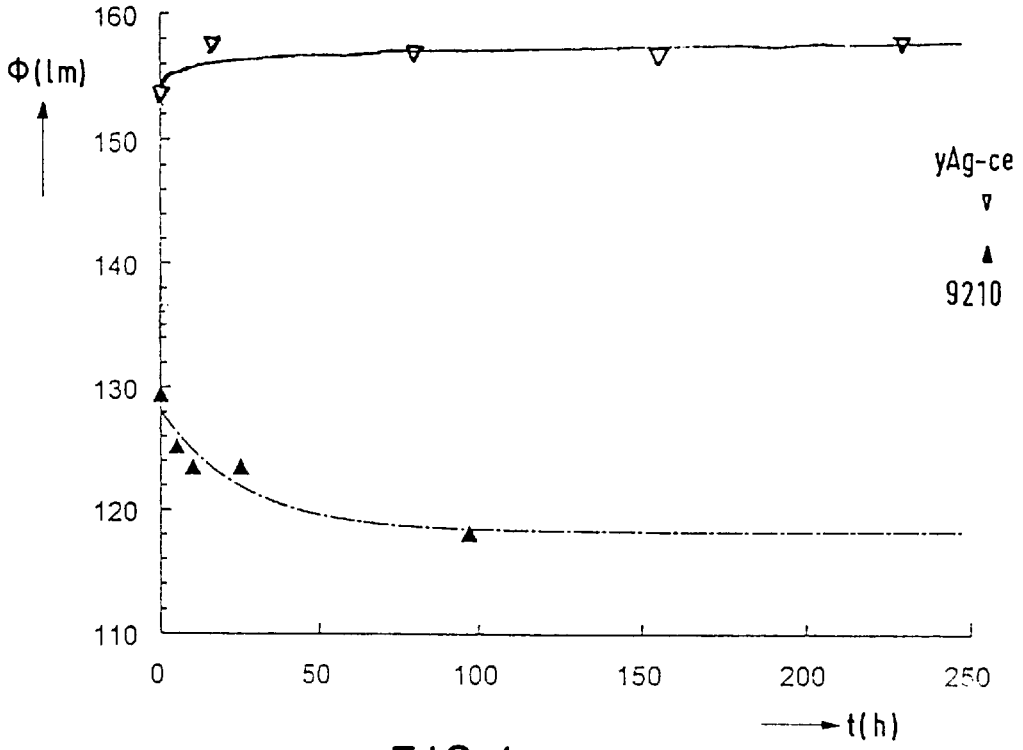
FIG. 4 shows the luminous flux values of two discharge lamps radiating amber light as a function of the number of hours of operation of the discharge lamps.
Figure 5:
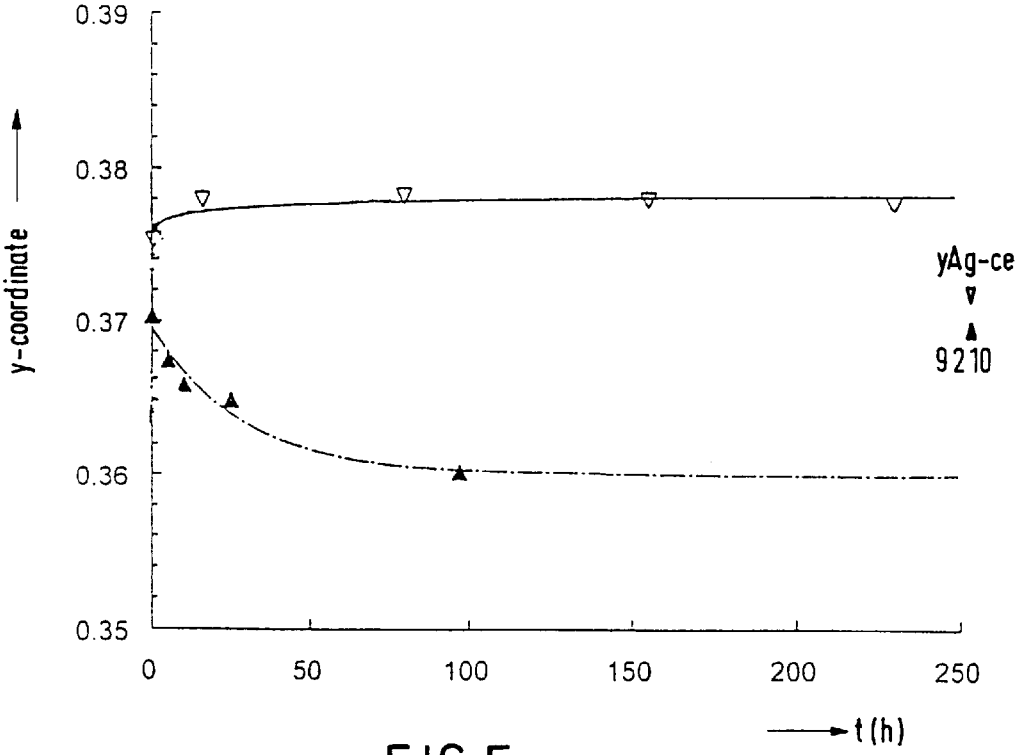
FIG. 5 shows the y coordinate of the colour point of the light radiated by discharge lamps as a function of the number of hours of operation of the discharge lamps.

The data shown in FIGS. 4 and 5 were obtained for discharge lamps whose discharge vessels had an inner diameter of 2.5 mm and a length of 40 cm. Electrodes made from a chromium-nickel-iron alloy were provided at the ends of the discharge vessel. The discharge lamps were filled with 25 neon and the discharge vessel wall was coated with approximately 2.5 mg luminescent material per $cm^2$ wall surface. The luminescent materials used were zinc silicate activated by bivalent manganese (supplier Philips; type G210) and yttrium-aluminium garnet activated by trivalent cerium (supplier Philips; type U728). The results shown in FIGS. 4 and 5 were obtained with a direct current of approximately 10 mA flowing through the discharge lamps during stationary lamp operation.

In alternative discharge lamps, the lamp vessel wall was coated with yttrium-aluminium garnet activated by trivalent cerium (again 2.5 mg per $cm^2$), and the neon filling pressure was 15 mbar. These alternative discharge lamps were partly provided with electrodes without emitter material and partly with electrodes having emitter material. It was found for these alternative discharge lamps that the colour point of the light radiated by the discharge lamp at a direct current of approximately 8 mA or less complied with the above E.C.E. requirements for direction indicator lights for use in/on a motorcar. The colour point remained within the required region also when the discharge lamp was aged.

In FIG. 4, the burning time (t) in hours is plotted on the horizontal axis and the luminous flux (Φ) in lumens on the vertical axis. The discharge lamps had a comparatively high luminous flux which is well maintained with an increasing number of burning hours. It is apparent that the discharge lamps having a luminescent layer comprising yttrium-aluminium garnet activated by trivalent cerium (indicated with YAG-Ce in FIGS. 4 and 5) produce a considerably higher luminous flux than do the discharge lamps whose luminescent layer comprises zinc silicate activated by bivalent manganese (indicated with G210 in FIGS. 4 and 5). In addition, the luminous flux of the discharge lamps with YAG-Ce increases slightly during the first 250 burning hours, whereas the luminous flux of the discharge lamps with G210 decreases during the first 100 burning hours and then remains approximately constant.

In FIG. 5, the burning time (t) in hours is plotted on the horizontal axis and the y coordinate of the light radiated by the discharge lamps on the vertical axis. It is apparent that the y coordinate of the discharge lamps with YAG-Ce rises slightly during the first 250 burning hours, whereas the y coordinate of discharge lamps with zinc silicate activated by bivalent manganese decreases substantially during approximately the first 100 burning hours.

Figure 6A:
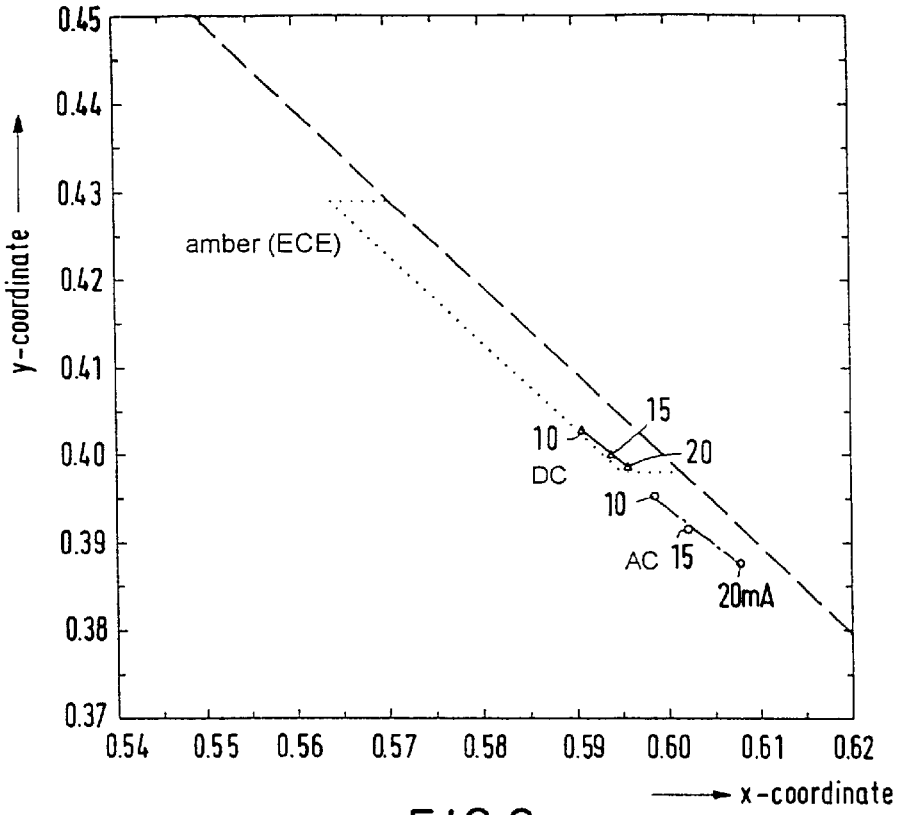
FIG. 6*a* shows the colour points of discharge lamps comprising one or more luminescent layers.

In FIG. 6*a* colour points are shown that were obtained by operating a discharge lamp having a neon gas filling with a pressure of 5 mbar. The inner diameter of the lamp vessel was 3.5 mm and the length of the lamp vessel was 40 cm. The lamp vessel was equipped with a luminescent layer consisting of yttrium-aluminium garnet activated by trivalent cerium. The region corresponding to the E.C.E. requirements for indicator lights is also shown in FIG. 6*a*. It can be seen that the colour point is within the E.C.E. requirements in case the discharge lamp was operated by means of a DC-current with a substantially constant amplitude. The amplitude of the DC-current was 10, 15 and 20 mA and the corresponding colour points are indicated as DC-10, DC-15 and DC-20 respectively. In case the discharge lamp was operated with a AC-current having an rms value of 10, 15 and 20 mA respectively, the obtained colour points AC-10, AC-15 and AC-20 are outside the region corresponding to the E.C.E. requirements.

Figure 6B:
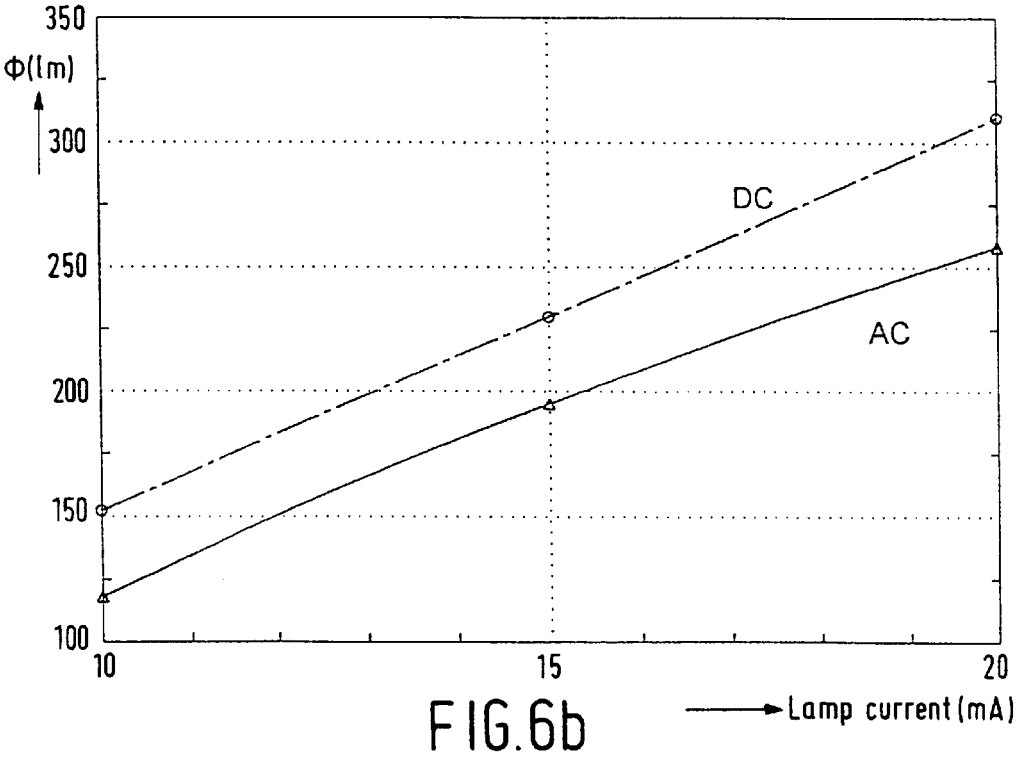
FIG. 6*b* shows the luminous fluxes of discharge lamps having a neon gas filling and a luminescent layer for both AC- and DC- operation.

In FIG. 6*b* the luminous flux (Φ) of this discharge lamp for both DC- and AC-operation is plotted as a function of the rms value of the lamp current. It can be seen that the luminous flux obtained by DC-operation is substantially higher than the luminous flux obtained by AC-operation. It can therefore be concluded that DC-operation offers substantial advantages over AC-operation both in terms of luminous flux as well as in terms of the position of the colour point. Furthermore DC-operation can be realized using relatively simple means and causes no or only a very small amount of electromagnetic interference.

Figure 7A:
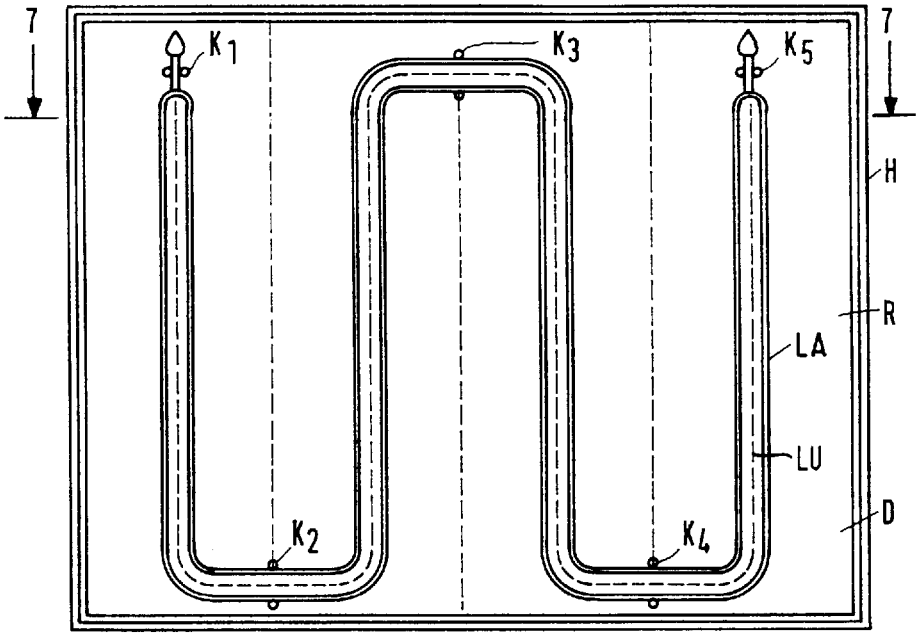
FIG. 7*a* shows a front elevation of a lighting unit according to the invention.
Figure 7B:
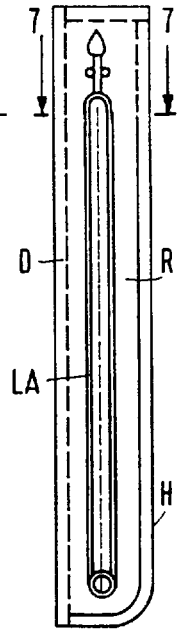
FIG. 7*b* shows a side elevation of the lighting unit of FIG. 7*a*.
Figure 7C:
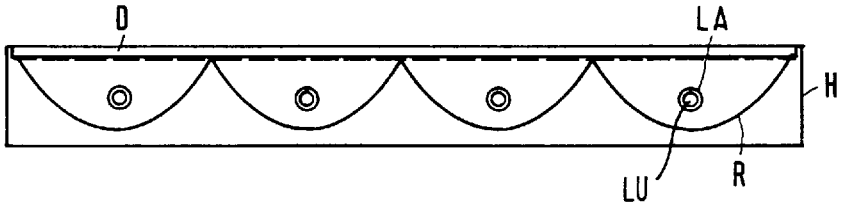
FIG. 7*c* shows a cross-section of the lighting unit of FIGS. 7*a* and 7*b*, taken along line 7—7 of FIGS. 7*a* and 7*b*.
Figure 7D:
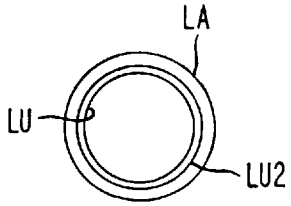

In FIG. 7, FIG. 7*a* is a front elevation of a lighting unit according to the invention. FIG. 7*b* is a side elevation of the same lighting unit. La is a discharge lamp bent in a plane and provided with a gas filling consisting of neon. The discharge lamp wall is provided with a luminescent layer LU. H is a housing with a rectangular aperture. A mirroring reflector R is provided in the housing, forming the reflecting surface in this embodiment. The rectangular aperture of the housing is closed off with a light-transmitting cover D. Clamps K1–K5 in this embodiment form means for positioning the discharge lamp in the housing. FIG. 7*c* is a cross-section of the lighting unit of FIGS. 7*a* and 7*b* taken on the cross-section line shown in FIGS. 7*a* and 7*b*, perpendicular to the plane in which the discharge lamp La was bent.

We claim:

1. A lighting unit comprising a discharge vessel having a wall provided with a luminescent screen comprising a first luminescent layer, a gas filling in said discharge vessel, said gas filling consisting essentially of neon having a pressure less than 30 mbar at ambient temperature, and means for providing a constant DC current for exciting said filling in said discharge vessel to emit ultraviolet light which excites the luminescent layer.

2. A lighting unit as claimed in claim 1, wherein the first luminescent layer comprises a green-luminescing substance.

3. A lighting unit as claimed in claim 2, wherein the first luminescent layer comprises zinc silicate activated by bivalent manganese.

4. A lighting unit as claimed in claim 2, wherein the first luminescent layer comprises the green-luminescing substance yttrium-aluminium garnet activated by trivalent cerium.

5. A lighting unit as claimed in claim 4, wherein the green-luminescing substance yttrium-aluminium garnet activated by trivalent cerium is of general formula $Y_{3-x}Al_5O_{12}:xCe^{3+}$, wherein $0.01 \leqq x \leqq 0.20$.

6. A lighting unit as claimed in claim 5, wherein part of the aluminium in the yttrium-aluminium garnet activated by trivalent cerium is replaced by gallium and/or scandium.

7. A lighting unit as claimed in claim 2, wherein the first luminescent layer comprises the green-luminescing substance yttrium silicate activated by trivalent terbium.

8. A lighting unit as claimed in claim 7, wherein the discharge lamp incorporates a filter.

9. A lighting unit as claimed in claim 7, wherein the luminescent screen comprises a second luminescent layer present between the first luminescent layer and the wall of the discharge vessel, said second luminescent layer comprising the green-luminescing substance yttrium-aluminium garnet activated by trivalent cerium.

10. A lighting unit as claimed in claim 9, wherein part of the aluminium in the yttrium-aluminium garnet activated by trivalent cerium is replaced by gallium and/or scandium.

11. A lighting unit as claimed in claim 2, wherein the first luminescent layer comprises a blue-luminescing substance.

12. A lighting unit as claimed in claim 11, wherein the blue-luminescing substance comprises one or more of the luminescent materials belonging to the group formed by $MgWO_4$, $Y_{2-x}O_2S:xTb^{3+}$and $Y_{2-x}SiO_5:xCe^{3+}$.

13. A lighting unit as claimed in claim 1, wherein the diameter of the discharge vessel is smaller than 5 mm.

14. A light unit as in claim 1 further comprising a housing having a reflective surface, said discharge vessel being positioned in said housing.

15. A lighting unit as in claim 1 wherein said pressure is less than 25 mbar.

16. Method for operating a discharge lamp comprising providing a discharge lamp comprising a discharge vessel having a wall provided with a luminescent screen comprising a first luminescent layer, providing said vessel with a gas filling consisting essentially of neon having a pressure less than 30 mbar at ambient temperature, and exciting said gas filling with a DC-current of substantially constant amplitude, thereby causing the filling to emit enough ultraviolet light to excite the luminescent layer.

17. Method as in claim 16 wherein said gas filling has a pressure of less than 25 mbar.

18. Method as in claim 16 wherein said DC-current is 20 mA or less.

* * * * *